US010933269B2

(12) United States Patent
Zhang

(10) Patent No.: US 10,933,269 B2
(45) Date of Patent: Mar. 2, 2021

(54) TEMPERATURE-SENSING AND AUTOMATIC ON AND OFF FIRE EXTINGUISHING DEVICE

(71) Applicant: SHANDONG BRIGHTMAN ENERGYTECHNOLOGY CO., LTD, Shandong (CN)

(72) Inventor: Qinghai Zhang, Shandong (CN)

(73) Assignee: SHANDONG BRIGHTMAN ENERGYTECHNOLOGY CO., LTD., Shandong (CN)

( * ) Notice: Subject to any disclaimer, the term of this patent is extended or adjusted under 35 U.S.C. 154(b) by 174 days.

(21) Appl. No.: 15/765,244

(22) PCT Filed: Nov. 28, 2015

(86) PCT No.: PCT/CN2015/095874
§ 371 (c)(1),
(2) Date: Mar. 30, 2018

(87) PCT Pub. No.: WO2017/054305
PCT Pub. Date: Apr. 6, 2017

(65) Prior Publication Data

US 2018/0289997 A1 Oct. 11, 2018

(30) Foreign Application Priority Data

Sep. 30, 2015 (CN) ..... 2015106362848

(51) Int. Cl.
*A62C 37/16* (2006.01)
*A62C 37/21* (2006.01)

(52) U.S. Cl.
CPC ..... *A62C 37/16* (2013.01); *A62C 37/21* (2013.01)

(58) Field of Classification Search
CPC ..... A62C 35/68; A62C 37/40; A62C 37/14; A62C 37/11; A62C 37/12; A62C 37/00
(Continued)

(56) References Cited

U.S. PATENT DOCUMENTS 3,811,511 A * 5/1974 McCulloch ..... A62C 35/08 169/28
3,834,463 A * 9/1974 Allard ..... A62C 37/10 169/28
(Continued)

FOREIGN PATENT DOCUMENTS

CN 201779344 U 3/2011
CN 203647932 U 6/2014
(Continued)

*Primary Examiner* — Qingzhang Zhou

(57) ABSTRACT

A temperature-sensing and automatic on and off extinguishing device includes: a valve body (1), a sealing auxiliary member (2), a sealing pad (3), a magnetic ring (4), a lower magnetic ring sleeve (5), an upper magnetic ring sleeve(6), a first temperature-sensing element (7), a bi-directional spacer (8), a large reset spring (9), a valve cover (17), a second temperature-sensing element (13), an actuating sleeve (12), a small reset spring (14), a connecting element (10), a sealing sleeve (18), a screw (11), a magnetic core rod (21) and a sealing cap (22). When a fire occurs, the first temperature-sensing element (7), affected by the rise of the surrounding environmental temperature, pushes the bi-directional spacer (8) to move upward.

2 Claims, 1 Drawing Sheet

(58) Field of Classification Search
USPC ..... 169/17, 16, 20, 43, 56, 60, 61
See application file for complete search history.

(56) References Cited

U.S. PATENT DOCUMENTS

| | | | | |
|---|---|---|---|---|
| 5,117,916 | A * | 6/1992 | Ohta | A62C 37/10 169/17 |
| 8,584,767 | B2 * | 11/2013 | Johnson | A62C 37/16 169/43 |

FOREIGN PATENT DOCUMENTS

| | | | |
|---|---|---|---|
| CN | 203770816 | U | 8/2014 |
| CN | 205163997 | U | 4/2016 |
| DE | 2356202 | A1 | 5/1975 |
| JP | 01212867 | A | 8/1989 |

* cited by examiner

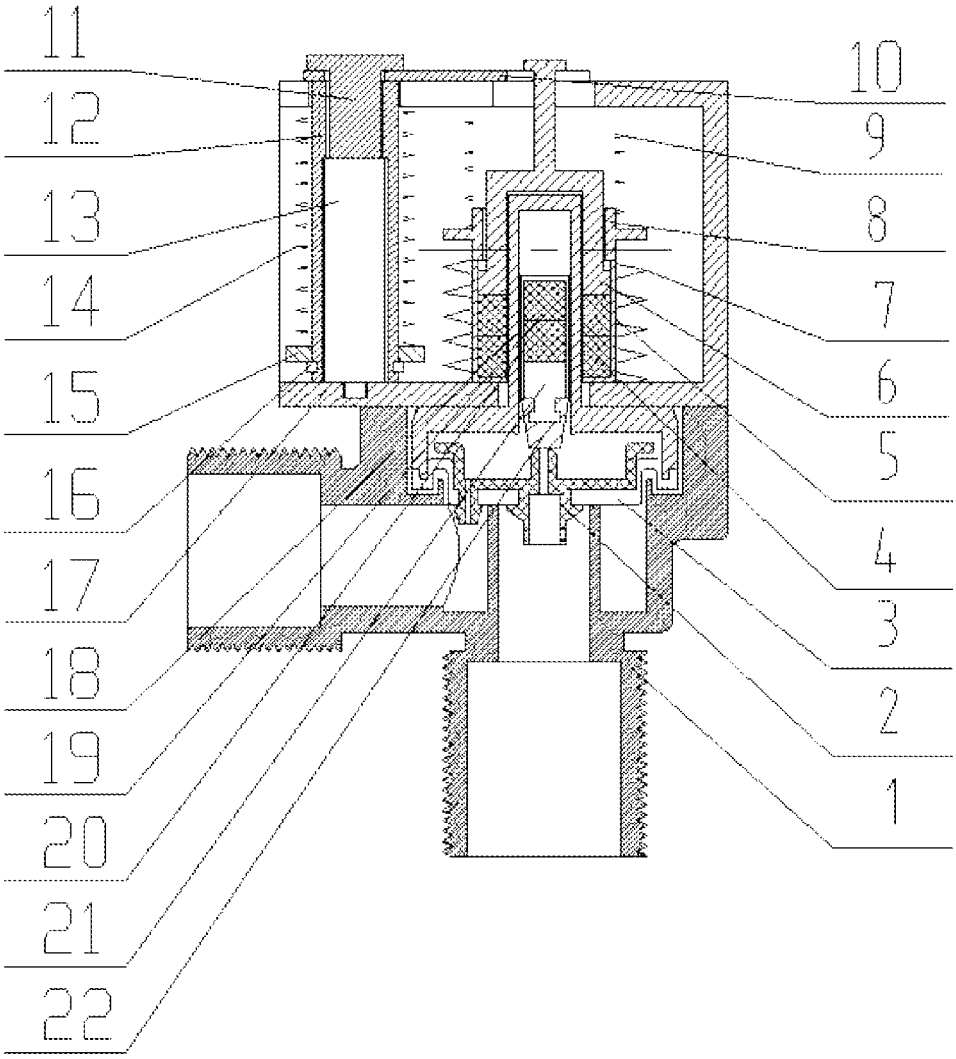
11
12
13
14
15
16
17
18
19
20
21
22
10
9
8
7
6
5
4
3
2
1

TEMPERATURE-SENSING AND AUTOMATIC ON AND OFF FIRE EXTINGUISHING DEVICE

CROSS REFERENCE OF RELATED APPLICATION

This is a U.S. National Stage under 35 U.S.C 371 of the International Application PCT/CN2015/095874, filed Nov. 28, 2015, which claims priority under 35 U.S.C. 119(a-d) to CN 201510636284.8, filed Sep. 30, 2015.

BACKGROUND OF THE PRESENT INVENTION

Field of Invention

The present invention relates to a device provided on a fire-fighting pipeline or a tap water pipeline, which is capable of sensing environmental temperature, automatically turning on water spray to extinguish fire when a fire occurs, and automatically turning off when the fire is extinguished and the environmental temperature drops below 45° C. The device of the present invention relates to the field of extinguishment equipment manufacture.

Description of Related Arts

In order to prevent fire, automatic sprinkler systems have been designed and installed in public buildings. Automatic sprinkler systems include components of sprinklers, alarm valve assemblies and water flow alarms, as well as pipelines, water supply facilities, etc. In the event of a fire on a building, the ethanol glass ball inside the sprinkler breaks, and the water flows out of the sprinkler to extinguish the fire, the alarm system alarms and starts the water supply. The fire sprinkler cannot be automatically turned off once it is turned on. When the fire is extinguished, if the valve of the water supply facility cannot be turned off in time, the sprinklers continue to spray water until the water in the tanks and pipes is sprayed out, resulting in a certain degree of secondary disasters. The automatic fire sprinkler system has a large investment, the fire control system is very complicated and needs to be attended by a dedicated person. The turn-on position of the sprinkler head is a fragile glass piece which is easy causing false alarms, and the sprinkler is a disposable good, and the professional needs to be replaced after use. Due to the defects of the sprinklers, the automatic sprinkler system is not suitable for residential houses. At present, there are no fire-fighting facilities in residential buildings, only fire hydrants are installed in stairwells. When a fire occurs in a household, the security doors of tenants must be opened to extinguish the fire, which usually causes a result that the best time to extinguish the fire is delayed. Sometimes the security doors cannot be opened and the ladders are erected outside the building, causing great difficulty in extinguishing the fire. Failure to promptly extinguish the first fire causes great damage to the residential houses, especially the high-rise residential buildings. The present invention provides a temperature-sensing on and off fire extinguishing device combined with an automatic sprinkler system in a public building. When a fire occurs in a building, the temperature-sensing automatic on and off fire extinguishing device turns on water in the pipeline to flow out of the sprinkler head to extinguish the fire; when the fire is extinguished, the temperature-sensing automatic on and off fire extinguishing device turns off the sprinklers to stop the spraying of water. The device is connected with indoor water pipes in residential buildings to form a simple fire extinguishing system, so as to save the cost of establishing a fire extinguishing system, when a room has a fire, sprays water in the right room; when the fire is extinguished, stop the water spray, and when the fire occurs again, the temperature-sensing automatic on and off fire distinguishing device is turned on again to extinguish the fire.

SUMMARY OF THE PRESENT INVENTION

Technical Problem

An object of the present invention is to provide a safe, reliable, convenient and reusable temperature-sensing automatic on and off fire-extinguishing device that does not rely on external force. When a fire occurs, the environmental temperature of the temperature-sensing and automatic on and off fire extinguishing device increases. When the temperature reaches a preset temperature on point which is corresponding to different usage environment according to the national standard of China, automatically turn on to extinguish the fire; and automatically turn off and terminate spraying when the environmental temperature drops below 45° C. after the fire is extinguished. The temperature-sensing automatic on and off fire-extinguishing device of the present invention provides a new type of fire extinguishing system for the residential buildings and the public buildings.

Technical Solutions

The technical solutions of the present invention are as follows.

A temperature-sensing automatic on and off fire-extinguishing device, comprising: a valve body, a sealing auxiliary member, a sealing pad, a magnetic ring, a lower magnetic ring sleeve, an upper magnetic ring sleeve, a first temperature-sensing element, a bi-directional spacer; a large reset spring; a valve cover; a second temperature-sensing element, a actuating sleeve; a small reset spring; a connecting element; a sealing sleeve; a screw; a magnetic core; a magnetic-core sleeve; a magnetic-core rod and a sealing cap; wherein the sealing pad is provided on a groove inside the valve body and below the sealing auxiliary member; the sealing auxiliary member is provided on the groove inside the valve body and above the sealing pad; the magnetic ring is provided inside the upper magnetic ring sleeve and the lower magnetic ring sleeve and sleeved on an external of the sealing sleeve; the magnetic core is provided on a top portion inside the magnetic core sleeve; the magnetic core rod is provided in the magnetic core sleeve and below the magnetic core; the sealing cap is sleeved on a low portion of the magnetic core rod; the sealing sleeve is provided on an external of the magnetic core sleeve and inside the upper magnetic ring sleeve and the lower magnetic ring sleeve; the lower magnetic ring sleeve is connected with the upper magnetic ring sleeve by riveting; the first temperature-sensing element is provided on an external of the lower magnetic ring sleeve and on a low portion of the bi-directional spacer; the bi-directional spacer is provided on an up portion of the first temperature-sensing element; the large reset spring is provided on an up portion of the bi-directional spacer and on an external of the upper magnetic ring sleeve; the connecting element is provided on an up portion of the valve cover; a first end of the connecting element is provided on a low portion of a convex of the upper magnetic ring sleeve; a second end of the connecting element is coaxially aligned with a screw hole of the actuating sleeve and fastened by a screw; the actuating sleeve is provided on an external of the second temperature-sensing element and inside the small reset spring; the second temperature-sensing element is provided in the actuating sleeve; the actuating sleeve is provided in the valve cover; the small reset spring is provided on an external of the actuating sleeve and on an up portion of the spacer; the valve cover is provided on an up portion of the valve body; the spacer is provided between the small reset spring and the circlip; the circlip is provided in a slot of the actuating sleeve on a low portion of the spacer; the valve cover and the valve body is connected by the screw.

Beneficial Effects

The beneficial effects of the present invention are as follows.

When fire occurs, the environmental temperature of the temperature-sensing and automatic on and off fire extinguishing device increases. When the temperature reaches a preset temperature on point which is corresponding to different usage environment according to the national standard of China, automatically turn on to extinguish the fire; and automatically turn off and terminate spraying when the environmental temperature drops below 45° C. after the fire is extinguished. The temperature-sensing automatic on and off fire-extinguishing device of the present invention provides a new type of fire extinguishing system for the residential buildings and the public buildings.

BRIEF DESCRIPTION OF THE DRAWINGS

Further description of the present invention is illustrated combining with the accompanying drawings and the preferred embodiments.

The FIGURE is a schematic sectional view of a temperature-sensing and automatic on and off fire extinguishing device in a normal working condition.

1—valve body; 2—sealing auxiliary member; 3—sealing pad; 4—magnetic ring; 5—lower magnetic ring sleeve; 6—upper magnetic ring sleeve; 7—first temperature-sensing element; 8—bi-directional spacer; 9—large reset spring; 10—connecting element; 11—screw; 12—actuating sleeve; 13—second temperature-sensing element; 14—small reset spring; 15—spacer; 16—circlip; 17—valve cover; 18—sealing sleeve; 19—magnetic core; 20—magnetic-core sleeve; 21—magnetic-core rod; 22—sealing cap.

DETAILED DESCRIPTION OF THE PREFERRED EMBODIMENT

Firstly, connect a sealing auxiliary member 2 with a sealing pad 3; put into a valve body 1; send a magnetic core 19 into a magnetic-core sleeve 20; send a magnetic-core rod 21 into the magnetic-core sleeve 20; put two magnetic cores 19 onto a top portion of the magnetic-core rod 21; connect the magnetic-core rod 21 with the magnetic-core sleeve 20 by riveting; sleeve a sealing cap 22 on a low portion of the magnetic-core rod 21 outside the magnetic-core sleeve 20; send two magnetic ring 4 into a lower magnetic ring sleeve 5; connect an upper magnetic ring sleeve 6 with the lower magnetic ring sleeve 5 by riveting; sleeve a first temperature-sensing element 7 on an external of the lower magnetic ring sleeve 5; sleeve a bi-directional spacer 8 on an external of the upper magnetic ring sleeve 6; send a large reset spring 9 into a valve cover 17; send a sealing sleeve 18 into the lower magnetic ring sleeve 5 and the upper magnetic ring sleeve 6; connecting and fixing the valve cover 17 with the valve body 1 by screw; send the second temperature-sensing element 13 into an actuating sleeve 12; send the actuating sleeve 12 into the valve cover 17 from a top of the valve cover 17; sleeve a small reset spring 14 on an external of the actuating sleeve 12; sleeve a spacer 15 on an external of the actuating sleeve 12 and below the small reset spring 14; sleeve a circlip 16 on a circlip groove on an external of the actuating sleeve; insert a first end of a connecting element 10 into a low edge of a convex above the upper magnetic ring sleeve 6; and coaxially align a second end of the connecting element 10 with a screw hole of the actuating sleeve 12; fasten with a screw 11.

EMBODIMENT OF THE PRESENT INVENTION

In use, the temperature-sensing and automatic on and off fire extinguishing device is connected on a tap water pipeline or a fire-fighting pipeline. When a fire occurs, water source is automatically turned on to extinguish the fire. When the fire is extinguished, the water source is automatically shut off.

INDUSTRIAL APPLICABILITY

The temperature-sensing automatic on and off fire-extinguishing device can be connected to a tap water line in a house to provide a fire extinguishing device for the house.

The temperature-sensing automatic on and off fire-extinguishing device can be connected to a fire-fighting pipe in a public building to provide a new fire extinguishing device.

What is claimed is:

1. A temperature-sensing automatic on and off fire-extinguishing device, comprising: a valve body, an auxiliary seal, a sealing pad, a magnetic ring, a lower magnetic ring sleeve, an upper magnetic ring sleeve, a first temperature sensor, a bi-directional spacer; a large reset spring; a valve cover; a second temperature sensor, a actuating sleeve; a small reset spring; a connector; a sealing sleeve; a screw; a magnetic core; a magnetic-core sleeve; a magnetic-core rod and a sealing cap; wherein the sealing pad is provided on a groove inside the valve body and below the auxiliary seal; the auxiliary seal is provided on the groove inside the valve body and above the sealing pad; the magnetic ring is provided inside the upper magnetic ring sleeve and the lower magnetic ring sleeve and sleeved on an external of the sealing sleeve; the magnetic core is provided on a top portion inside the magnetic core sleeve; the magnetic core rod is provided in the magnetic core sleeve and below the magnetic core; the sealing cap is sleeved on a low portion of the magnetic core rod; the sealing sleeve is provided on an external of the magnetic core sleeve and inside the upper magnetic ring sleeve and the lower magnetic ring sleeve; the lower magnetic ring sleeve is connected with the upper magnetic ring sleeve by riveting; the first temperature sensor is provided on an external of the lower magnetic ring sleeve and on a low portion of the bi-directional spacer; the bi-directional spacer is provided on an up portion of the first temperature sensor ; the large reset spring is provided on an up portion of the bi-directional spacer and on an external of the upper magnetic ring sleeve; the connector is provided on an up portion of the valve cover; a first end of the connector is provided on a low portion of a convex of the upper magnetic ring sleeve; a second end of the connector is coaxially aligned with a screw hole of the actuating sleeve and fastened by the screw; the actuating sleeve is provided on an external of the second temperature sensor and inside the small reset spring; the second temperature sensor is provided in the actuating sleeve; the actuating sleeve is provided in the valve cover; the small reset spring is provided on an external of the actuating sleeve and on an up portion of the Bi-directional spacer; the valve cover is provided on an up portion of the valve body; the spacer is provided between the small reset spring and a circlip; the circlip is provided in a slot of the actuating sleeve on a low portion of the spacer; the valve cover and the valve body is connected by the screw.

2. The temperature-sensing automatic on and off fire-extinguishing device, as recited in claim , which is characterized in being capable of reused; automatically turning on water spray to extinguish fire when a temperature reaches a preset opening temperature according to different usage environment; and automatically turning off and terminating spraying when the environmental temperature drops below 45° C. after the fire is extinguished.

* * * * *